US005871300A

United States Patent [19]

Ingham

[11] Patent Number: 5,871,300

[45] Date of Patent: Feb. 16, 1999

[54] METHOD AND APPARATUS FOR DEPLOYING A VEHICLE TIRE DEFLATOR

[76] Inventor: Frank B. Ingham, 1030 Anderson St., Alexandria, Va. 22312

[21] Appl. No.: 773,381

[22] Filed: Dec. 26, 1996

[51] Int. Cl.[6] ..... E01F 13/00; E01F 9/00

[52] U.S. Cl. ..... 404/6; 404/9; 256/1

[58] Field of Search ..... 404/6, 9, 15, 16; 256/1

[56] References Cited

U.S. PATENT DOCUMENTS

| | | | |
|---|---|---|---|
| 4,097,170 | 6/1978 | Dickinson | 404/6 |
| 4,995,756 | 2/1991 | Kilgrow et al. | 404/6 |
| 5,253,950 | 10/1993 | Kilgrow et al. | 404/6 |
| 5,536,109 | 7/1996 | Lowndes | 404/6 |
| 5,599,235 | 2/1997 | Lynberg | 14/69.5 |

*Primary Examiner*—Tamara L. Graysay
*Assistant Examiner*—Sunel Singh
*Attorney, Agent, or Firm*—J. Adam Neff

[57] ABSTRACT

An apparatus for deploying a vehicle tire deflator that can be folded into a compact state and unfolded into an expanded state, comprising a housing adapted to accommodate the vehicle tire deflator in the compact state. The housing has an opening through which a force transmitting element can act upon the tire deflator to unfold the tire deflator from the compact state to the expanded state. The housing is structured to support a weight of a motor vehicle without significant deformation.

18 Claims, 10 Drawing Sheets

METHOD AND APPARATUS FOR DEPLOYING A VEHICLE TIRE DEFLATOR

BACKGROUND OF THE INVENTION

1. Field of the Invention

This invention relates to a method and apparatus for deploying a vehicle tire deflator or similar device used, for example, by a law enforcement official to disable a vehicle operated by a violator.

2. Description of Related Art

A portable vehicle tire deflator is disclosed in U.S. Pat. No. 4,995,756, the disclosure of which is incorporated herein by reference. This device provides a foldable frame from which protrudes a plurality of spikes. The frame can be folded into a compact storage state and unfolded into a deployed state.

Effective deployment of this device requires that three mandatory conditions be met: 1) A substantial margin of safety must exist for the deploying official; 2) there must be minimal risk of damaging uninvolved vehicles; and 3) the fleeing vehicle must be substantially and safely disabled.

Unfortunately, current storage and deployment procedures do not make possible the simultaneous fulfillment of all three of the aforementioned conditions. For example, a user typically must open a carrying case, remove the deflator, and prepare to deploy the deflator using one of three methods; pushing, throwing, or pulling. Pushing or throwing the deflator into the path of an oncoming vehicle requires the user to remain in close proximity to the target vehicle's path. This condition is unacceptably hazardous to the user, especially when the target vehicle is moving at high speed and is operated by a person of dubious character or intent.

Furthermore, because of the direct handling of the deflator, the user is exposed to the spikes while removing the device from its case, standing in position, and so forth. This forces the user to move with caution, thereby hindering rapid deployment of the device. Moreover, the official's attention is diverted while deploying the device, whereby an additional element of danger is introduced. Many other factors may be present, some or all of which are beyond the control or the law enforcement official.

Pulling the deflator into deployment by an attached rope is safer to the user, but requires that the deflator be initially positioned in an exposed condition on the roadway where uninvolved vehicles may encounter the spikes and be damaged.

A further problem with the above-mentioned tire deflator is that it is commonly provided with a strong rope attached to aid in deployment of the device. If the device and/or the rope becomes entangled in a passing vehicle, it poses significant danger to a user who may become entangled by the rope and either dragged or otherwise severely injured.

In order to enhance the personal safety of a user of the above-mentioned tire deflator, a deployment method is needed that substantially reduces the number of significant factors affecting deployment and minimizes the possibility of personal injury.

SUMMARY OF THE INVENTION

It is an object of the present invention to provide a tire deflator housing that allows interim vehicular traffic to safely pass or cross a tire deflator until the deflator is extended into a deployed condition.

It is another object of the invention to allow a user to place a tire deflator housing with an enclosed tire deflator at a location that allows the user to safely deploy a tire deflator upon arrival of a specific target vehicle.

It is a further object of the invention to provide a storage/carrying case for a tire deflator that facilitates rapid deployment of the deflator with no direct handling of the deflator.

It is a still further object of the invention to eliminate or substantially reduce the safety threat posed by a rope of excessive strength attached to a tire deflator.

Other objects, advantages, and salient features of the present invention are disclosed and/or will become apparent to those skilled in the art from the following drawings and detailed description of preferred embodiments.

DETAILED DESCRIPTION OF PREFERRED EMBODIMENTS

Figure 3:
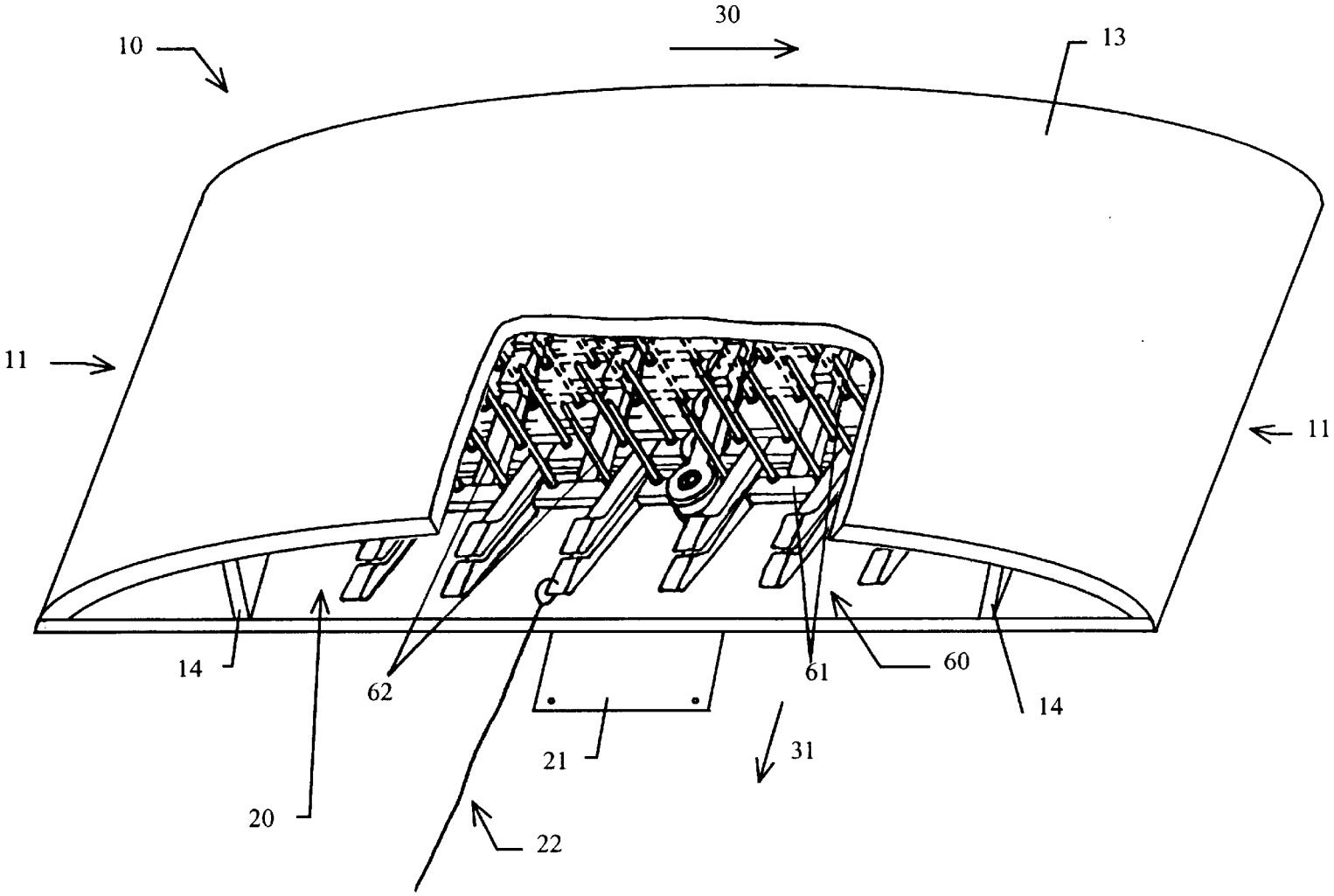
FIG. 3 illustrates a portable vehicle tire deflator housing of the present invention having a tire deflator housed therein in a compact state.
Figure 4:
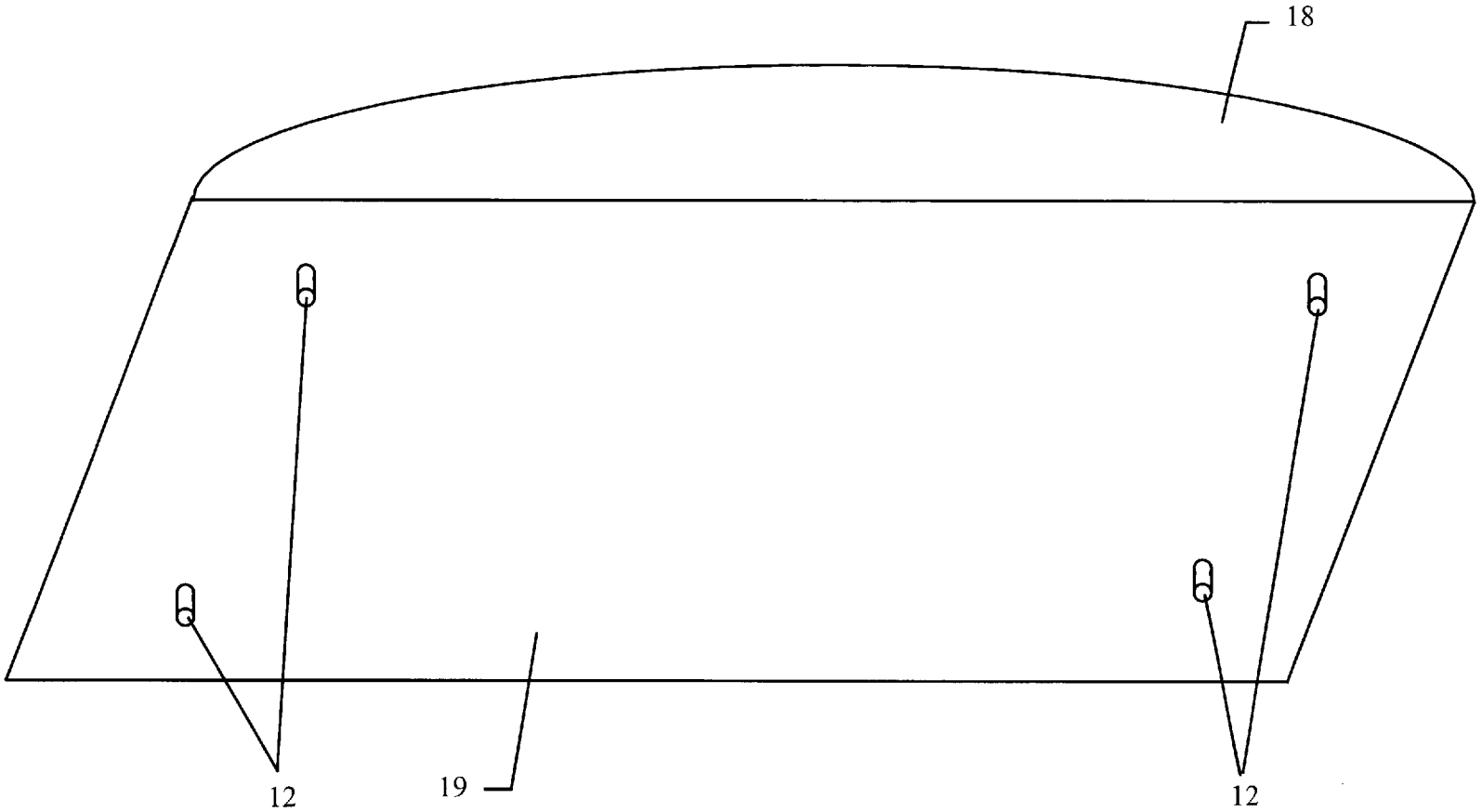
FIG. 4 illustrates a rear bottom oblique view of the deflator housing of the present invention.

In a first embodiment, illustrated in FIGS. 3–4, a housing 10 is shown with a tire deflator 60 positioned therein in a folded or compact state. Sides 11 of the housing 10 are curvedly tapered to allow a vehicle to drive over the housing 10 in, for example, a direction shown by arrow 30. Horizontal displacement preventing projections 12 (FIG. 4) depend from the housing for engaging the ground or road surface upon which the deflator is to be deployed. The cylindrical projections 12 shown are anticipated to be suitable for engagement with most asphalt and concrete roadways, although pointed or sharpened projections may also be employed.

The housing should be sufficiently rigid to withstand repeated impact by heavy traffic without deflecting enough to damage the tire deflator housed therein. Depending on the materials used in fabrication, the inherent strength of the housing may be sufficient to prevent deflection. If necessary, various strengthening measures can be taken. For example, reinforcing members 14 may be provided to prevent excessive deflection of the housing top 13 when crossed by a vehicle.

Figure 5:
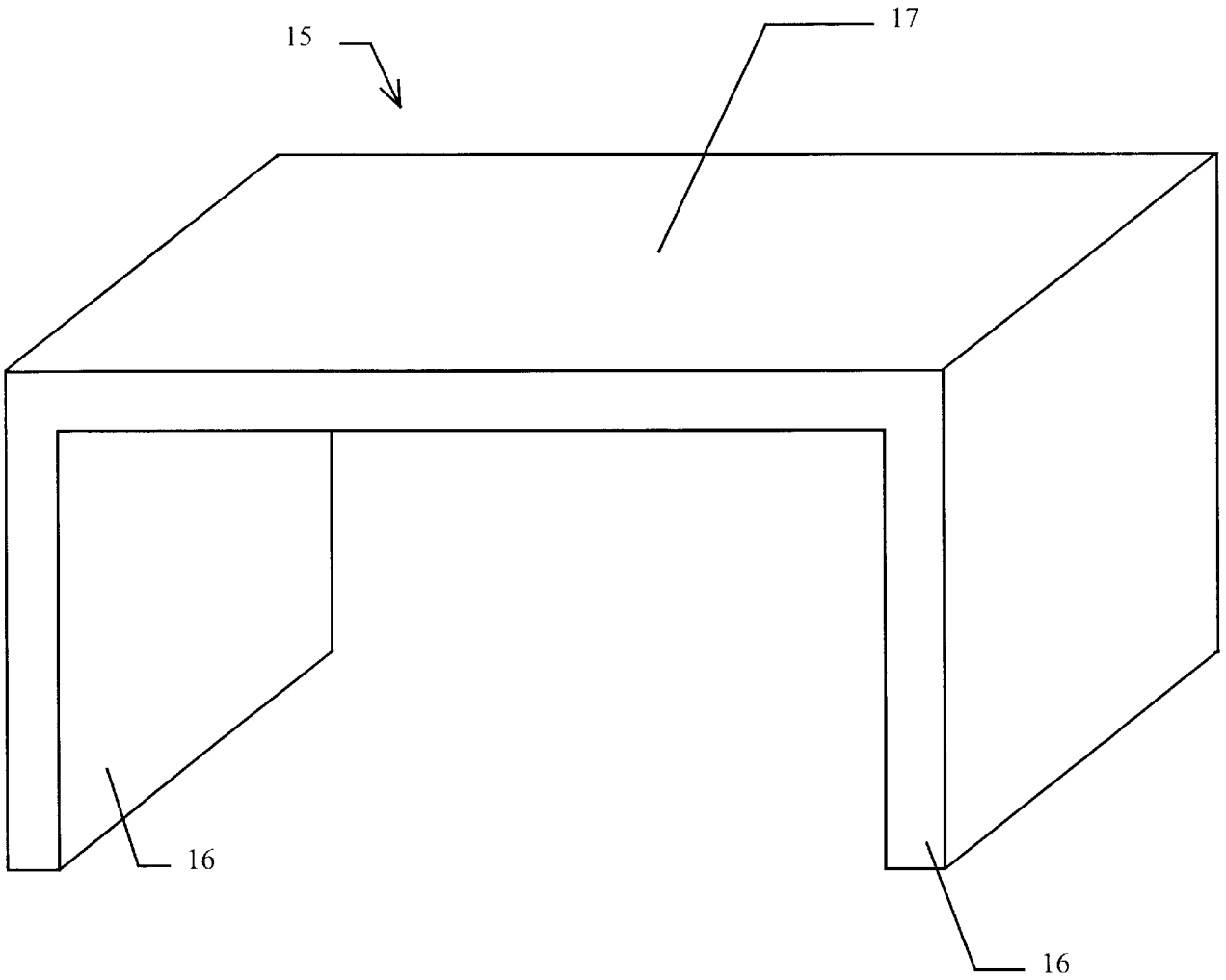
FIG. 5 illustrates a deflection preventing member to be used in conjunction with the deflator housing of the present invention.

Additionally, a supplemental support may be provided. For example, a housing distortion inhibiting member 15 (FIG. 5) may be provided and placed so that vertical members 16 bear against cross members 61 of the deflator 60 in the compact state. The compact deflator 60 can then be slid into the housing with the member 15 thus positioned. The housing distortion inhibiting member 15 provides a bearing surface 17 above the sharpened end of the spikes 62 of the tire deflator. This prevents the housing top 13 from being deflected to a point at which plastic deformation of the housing 10 or contact with the spikes 62 occurs. When the deflator 60 is deployed, the distortion inhibiting member 15 simply slides out of the housing 10 along with the deflator 60 and does not hinder deployment of the deflator 60.

A back housing wall 18 (FIG. 4) may be provided in rigid connection with the housing top to give further rigidity to the housing. Attaching the ends of the curved housing top 13 to a housing bottom 19 also results in enhanced rigidity.

At least one end 20 of the housing 10 is left substantially open to allow the deflator 60 to be withdrawn from the housing in, for example, the direction shown by arrow 31. One or more straps 21 or other closure members having a snap or hook-and-loop fastener-type closure not shown or the like is preferably provided along the substantially open side of the housing for securing the deflator within the housing while in a storage condition. The strap 21 is easily and quickly undone when preparing the system for deployment.

Figure 1:
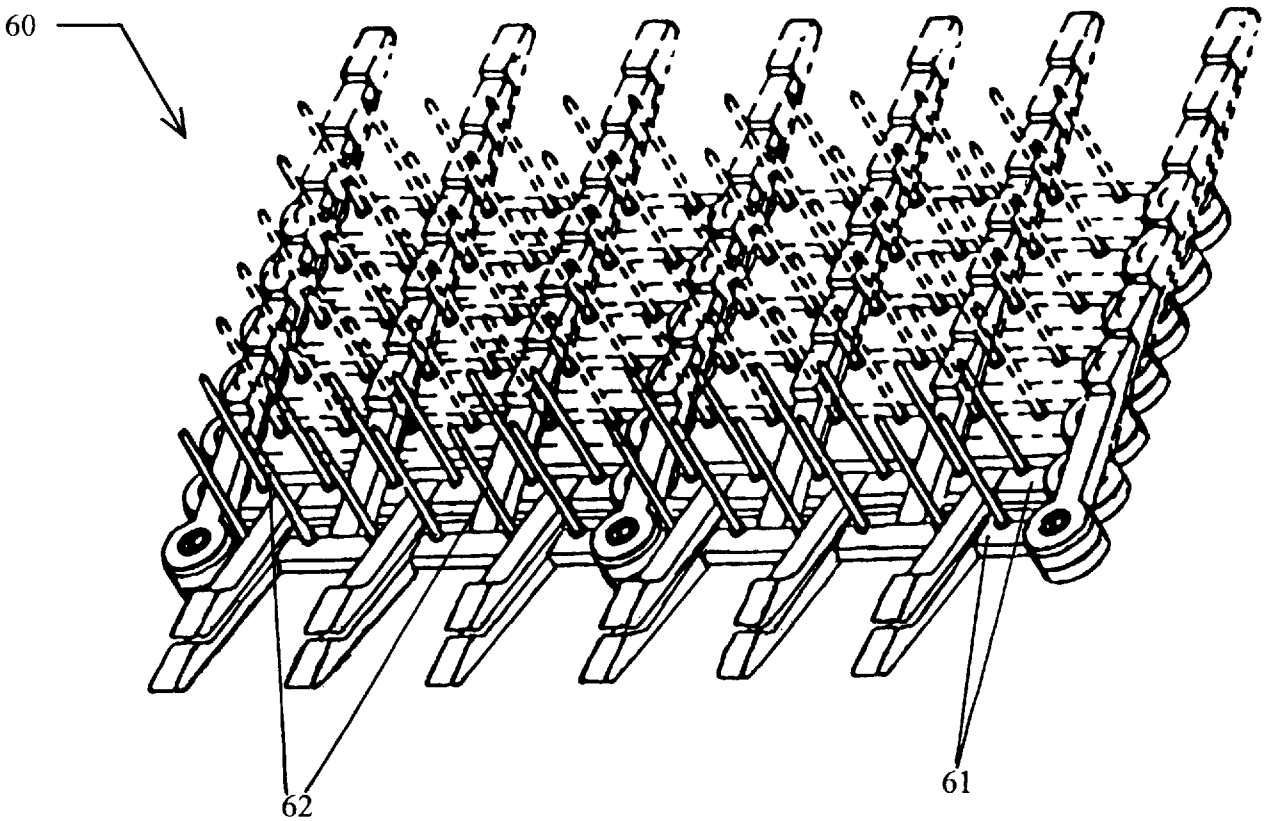
FIG. 1 (Prior Art)
FIG. 1 illustrates a portable vehicle tire deflator in a compact state.
Figure 2:
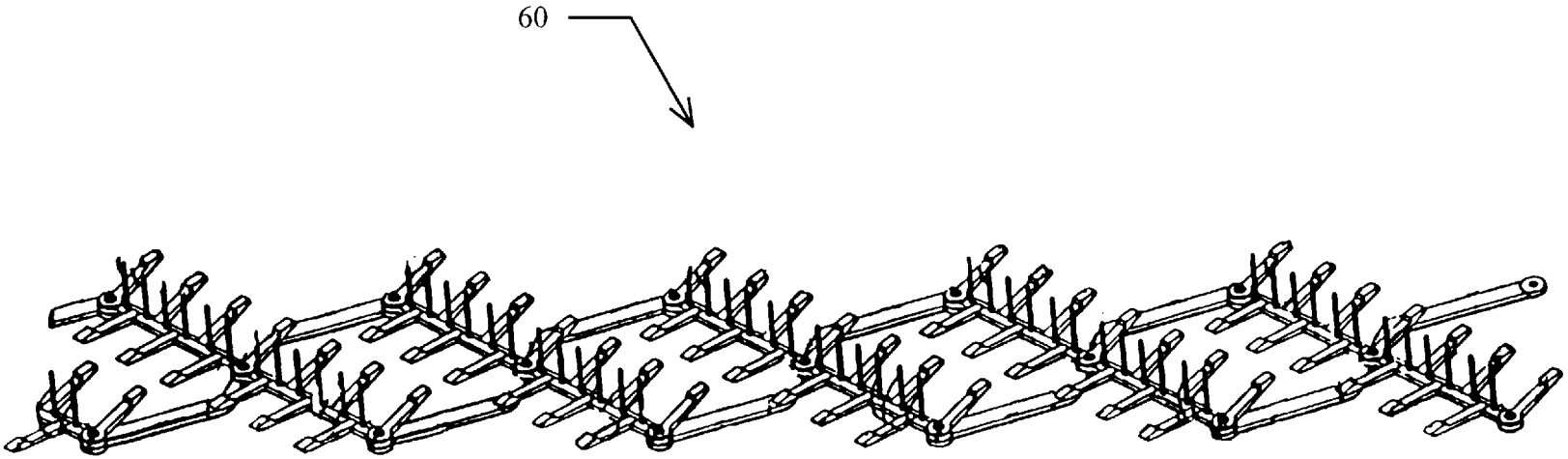
FIG. 2 (Prior Art)
FIG. 2 illustrates a portable vehicle tire deflator in an expanded state.

A tension-transmitting element 22 (a rope, for example) is attached to one end of the tire deflator 60. This element should have enough strength to transmit a force sufficient to pull or jerk the deflator 60 into a deployed condition (FIG. 2). However, the element 22 should easily break or yield if the element and/or deflator becomes entangled in a moving vehicle while a police officer's hand or other limb is accidentally entangled. The optimum strength of element 22 may be determined empirically, and may even be user-specific, but may, for example, be less than 50 pounds, preferably between 20 and 50 pounds. Optionally or additionally, lines of weakness (not shown) may be provided on deflator 60 at or near the point of attachment so that the deflator will break away from element 22 if acted upon by an excessive force. Alternatively, a break-away coupling (not shown) may be provided in element 22.

Figure 6:
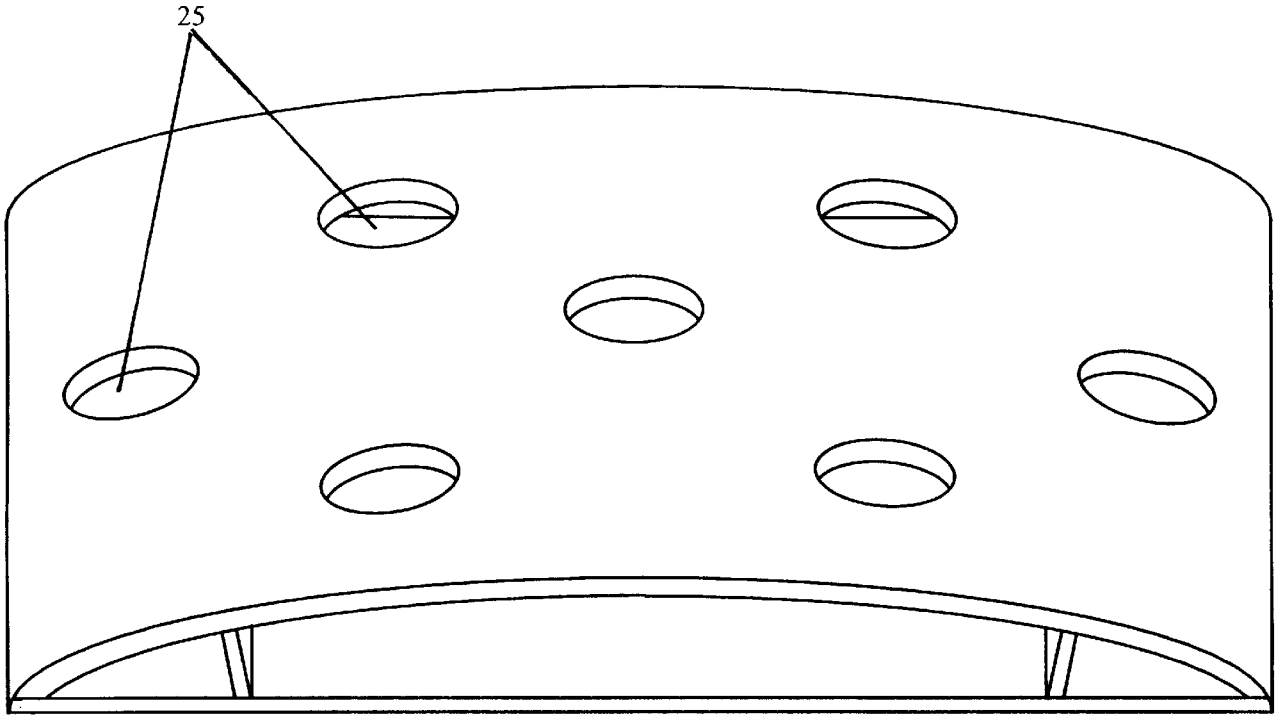
FIG. 6 illustrates a second embodiment of the present invention.

FIG. 6 illustrates a second embodiment of the housing 10. Pressure relieving apertures 25 are provided in the housing 10 to reduce the updraft effect of vehicles travelling over the housing at highway speeds, thus enhancing the stability of the housing. The apertures may be of any desired or appropriate number, size, or shape, but should be spaced in an optimum manner (i.e., staggered) to avoid unnecessary weakening of the housing.

Figure 7A:
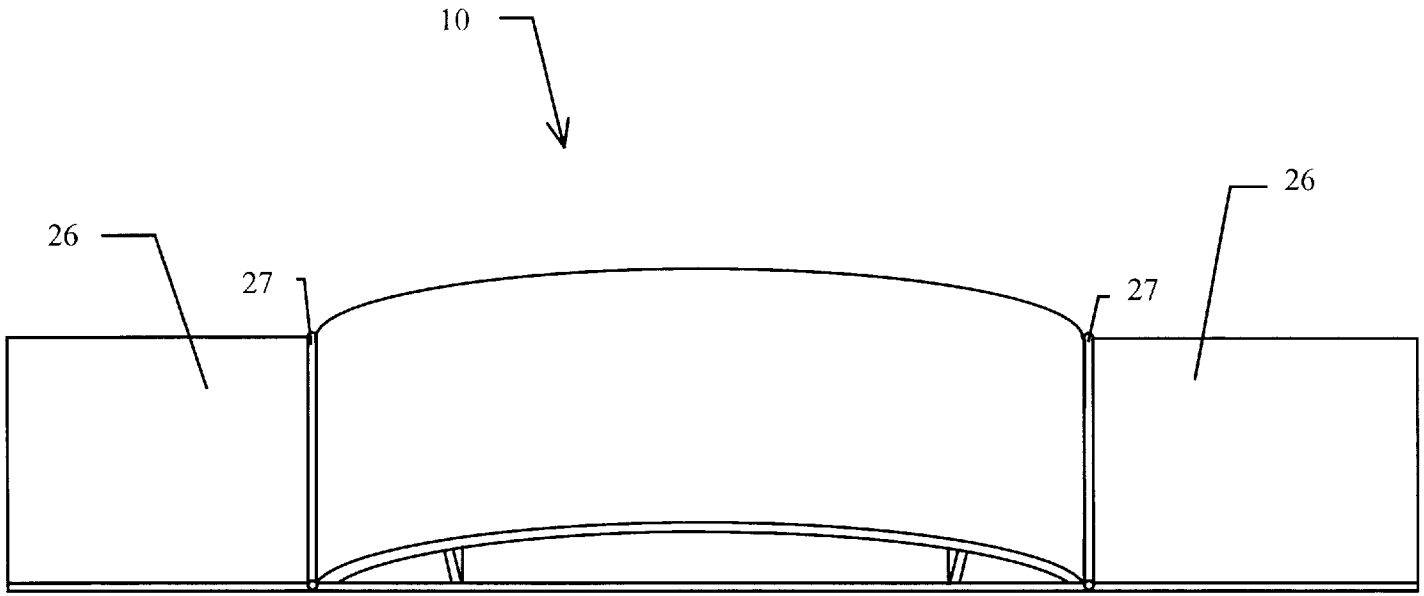
FIG. 7A illustrates a third embodiment of the present invention.
Figure 7B:
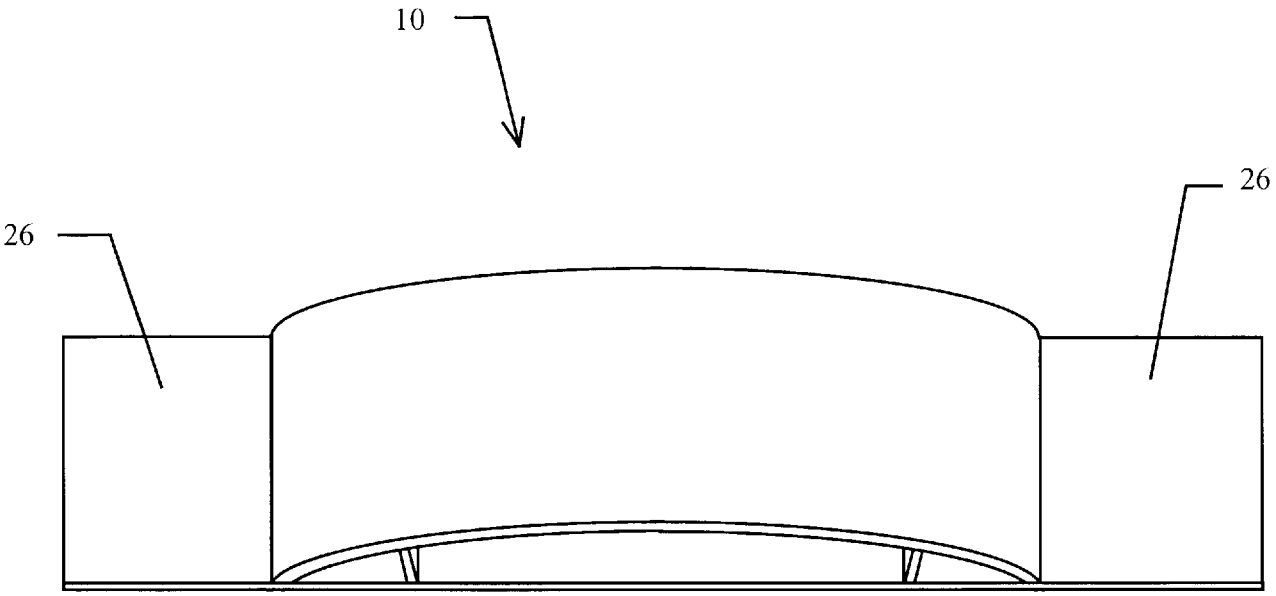
FIG. 7B illustrates a fourth embodiment of the present invention.

FIGS. 7A and 7B illustrate third and fourth embodiments, respectively, of the housing 10 in which initial wheel contact projections 26 are provided on either side of the housing 10. When a wheel crosses an initial wheel contact projection 26, a downward vertical force is transmitted to the housing 10, thereby anchoring the housing 10 and facilitating mounting of the housing 10 by the wheel. The projections 26 may be attached rigidly to the housing 10, as shown in FIG. 7B or may be attached by hinge members 27, as shown in FIG. 7A.

Figure 8:
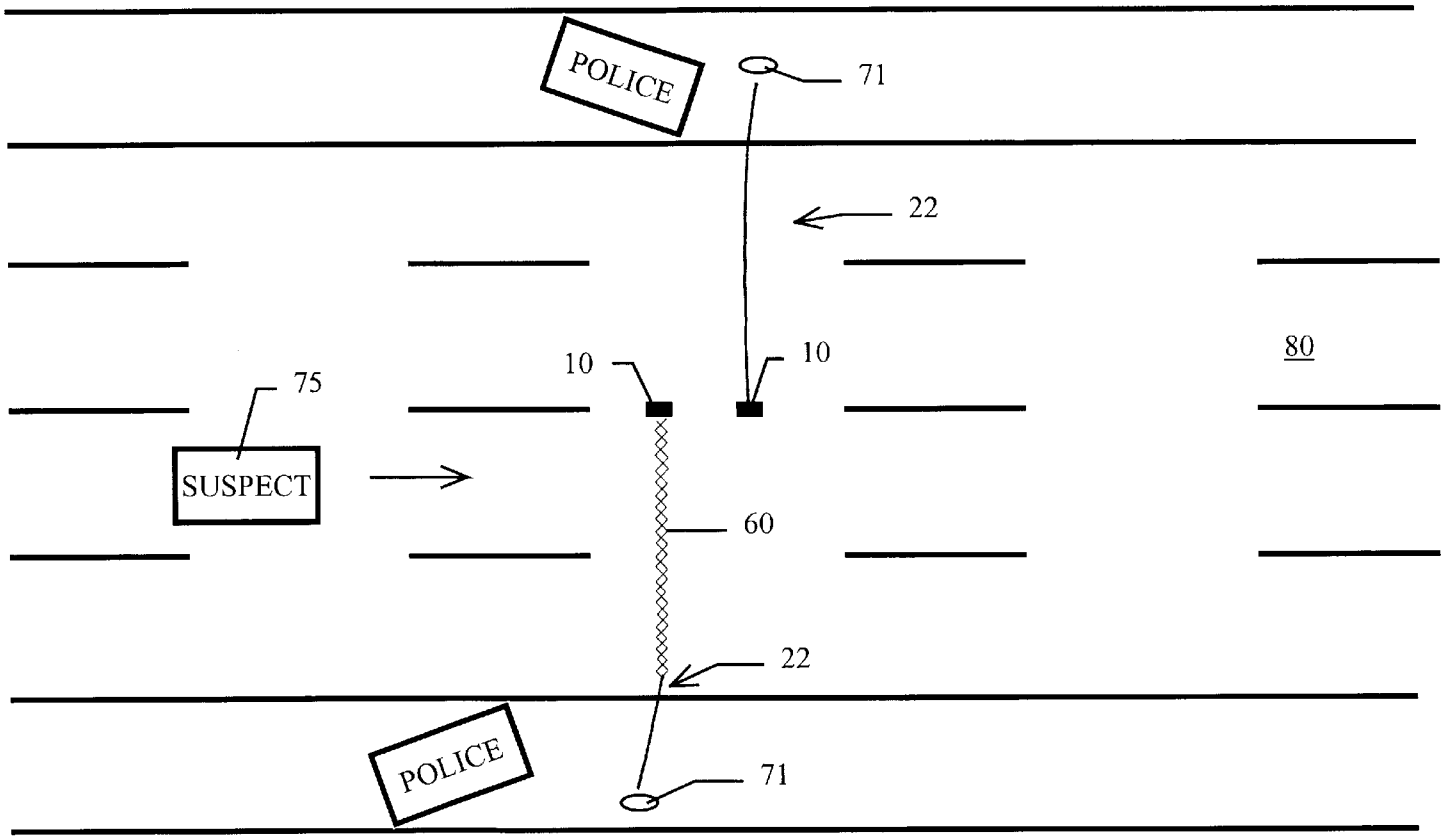
FIG. 8 illustrates a possible scenario in which the present invention is deployed.
Figure 9:
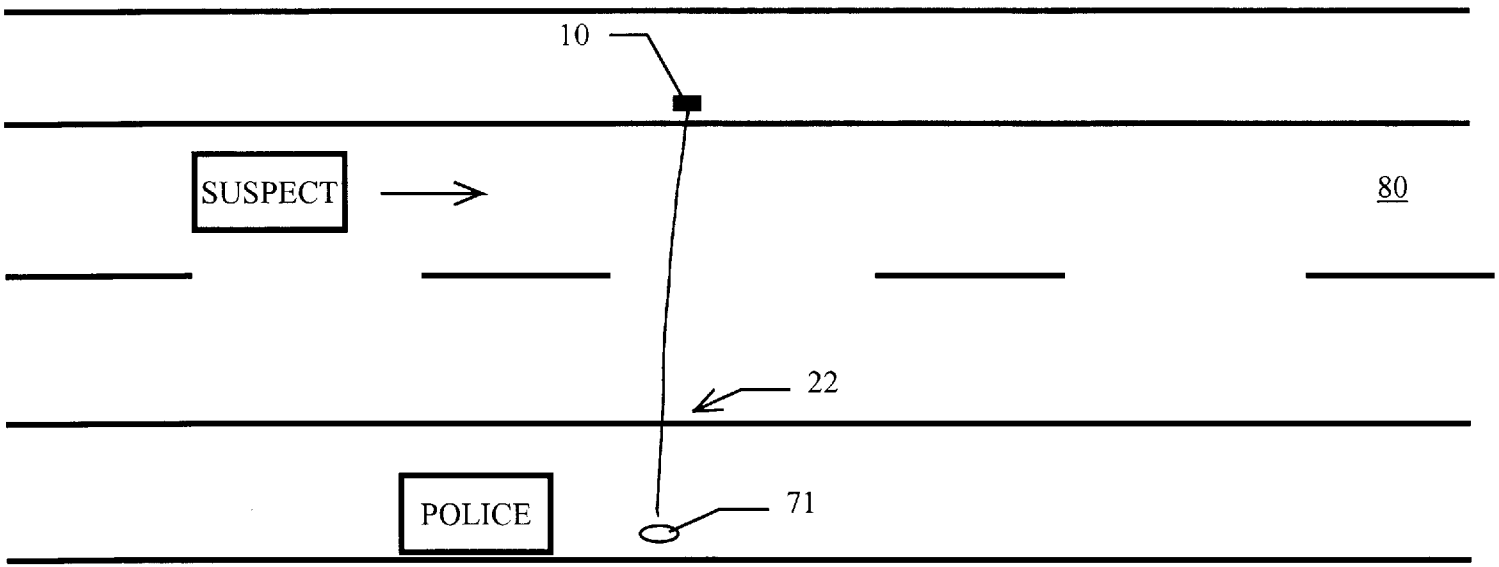
FIG. 9 illustrates another possible scenario in which the present invention is deployed.

FIGS. 8 and 9 illustrate possible scenarios in which the inventive tire deflation system is deployed. A user 71 places the housing 10 on a deployment surface 80 at a desired position with the deflator 60 accommodated therein in the compact condition. The tension transmitting element 22 is laid out in an extended condition. The user then retreats to a position of safety from which a force can be applied to element 22. A probable path of a target vehicle 75 lies between the user and the housing. While the user is awaiting the arrival of the target vehicle, interim traffic can safely bypass or cross over the housing 10 without encountering the spikes 62 of the deflator 60. As the target vehicle approaches, the user pulls or jerks the tension transmitting element 22, thereby extending the deflator into the deployed state.

FIG. 8 illustrates deployment of multiple deflator systems by multiple users on a 4-lane highway, while FIG. 9 illustrates deployment by a single user on a two-lane highway. Alternatively, a single user could simultaneously deploy multiple devices.

If the deflator and/or tension transmitting element 22 becomes entangled, for example, in a wheel, frame, or axle of the target vehicle, the deflator 22 will break away at the lines of weakness (not shown) and/or the element 22 will break away by virtue of the pre-selected strength of the element 22.

Although the invention has been described in relation to preferred embodiments, these embodiments are intended to be illustrative and not limiting. Variations and modifications are possible without departing from the spirit and scope of the invention. For example, although the preferred embodiments utilize a curved housing shape, other housing shapes are possible. For example, the housing shape may be trapezoidal, or may be specially optimized, such as with a variable radius of curvature including an infinite radius of curvature near the ends to enhance smoothness as a vehicle traverses the housing. Additionally, although cylindrical displacement preventing projections have been disclosed, other displacement prevention possibilities exist, such as spikes, fins, or anti-skid surfaces such as rubber.

What is claimed is:

1. An apparatus for deploying a vehicle tire deflator that can be folded into a compact state and unfolded into an expanded state, comprising:

a housing adapted to accommodate the vehicle tire deflator in the compact state, the housing having an opening through which a force transmitting device can act upon the vehicle tire deflator to unfold the vehicle tire deflator from the compact state to the expanded state, the housing being structured to allow motor vehicle traffic to safely traverse the housing.

2. The apparatus as recited in claim 1, wherein the housing is structured to support a weight of a motor vehicle without excessive deformation.

3. The apparatus as recited in claim 1, wherein the housing further comprises at least one tapered side.

4. The apparatus as recited in claim 1, wherein the force transmitting device comprises rope.

5. The apparatus as recited in claim 1, wherein the force transmitting device has a maximum strength of less than 50 lbs.

6. The apparatus as recited in claim 1, further comprising displacement prevention means to prevent the housing from being substantially displaced from an original position.

7. The apparatus as recited in claim 1, further comprising at least one housing distortion preventing member to prevent substantial distortion of the housing.

8. The apparatus as recited in claim 6, wherein the prevention displacement means comprises one of cylindrical projections, spikes, tabs, and protrusions projecting from a bottom surface of the housing.

9. The apparatus as recited in claim 1, further comprising at least one initial wheel contact projection attached to a side edge of the housing.

10. The apparatus as recited in claim 9, wherein the at least one initial wheel contact projection is rigidly attached to the side edge of the housing.

11. The apparatus as recited in claim 9, wherein the at least one initial wheel contact projection is pivotally attached to the side edge of the housing.

12. The invention as recited in claim 1, wherein holes are provided in a top surface of the housing.

13. A method of deploying a vehicle tire deflator that can be folded into a compact state and unfolded into an expanded state, comprising:

providing a housing sized to accommodate the vehicle tire deflator in the compact state and structured to allow motor vehicle traffic to safely traverse the housing, the housing having an opening through which a force transmitting device can act upon the vehicle tire deflator to unfold the vehicle tire deflator from the compact state to the expanded state;

positioning the housing at a desired location with the vehicle tire deflator positioned within the housing in the compact state; and applying a force to the force transmitting device, thereby withdrawing the tire deflator from the housing into the expanded state.

14. A vehicle disabling system, comprising:

a tire deflator comprising tire piercing spikes supported by support arms, the support arms being foldable into a compact state and a deployed state;

a force transmitting device attached to the support arms; and a housing adapted to accommodate the tire deflator in the compact state and protect the tire deflator from crossing motor traffic, the housing having an opening through which the force transmitting device can act upon the support arms to unfold the tire deflator from the compact state to the expanded state.

15. The system as recited in claim 14, wherein the housing further comprises displacement-preventing means to prevent horizontal displacement of the housing means.

16. The system as recited in claim 14, further comprising a securing device connectable to the housing for selectively securing the tire deflator within the housing and permitting access to allow the tire deflator to be unfolded into the expanded state.

17. The system as recited in claim 14, wherein the force transmitting device further comprises a break-away device that allows the tire deflator to break away from the force transmitting device at a predetermined force.

18. The system as recited in claim 14, further comprising a distortion preventing device for preventing substantial distortion of the housing.

* * * * *